US005203518A

United States Patent [19]

Morgan

[11] Patent Number: 5,203,518

[45] Date of Patent: Apr. 20, 1993

[54] CREEL ADAPTER

[76] Inventor: Arthur C. Morgan, P.O. Box 3187, Cumberland, Md. 21502

[21] Appl. No.: 743,450

[22] Filed: Aug. 9, 1991

[51] Int. Cl.[5] ..... B65H 49/06; B65H 49/36

[52] U.S. Cl. ..... 242/130; 242/46.3; 242/129.5; 242/130.1

[58] Field of Search ..... 242/130, 130.1, 130.3, 242/130.4, 131, 131.1, 134, 139, 141, 129.7, 129.71, 129.5, 46.2, 46.21, 46.3, 46.4, 46.5, 46.6

[56] References Cited

U.S. PATENT DOCUMENTS

| | | | |
|---|---|---|---|
| 558,437 | 4/1896 | Tivy et al. | 242/46.3 X |
| 2,915,260 | 12/1959 | Parrott | 242/130 |
| 3,055,609 | 9/1962 | Courtney | 242/130.1 |
| 4,291,842 | 9/1981 | Isoard | 242/46.5 |

*Primary Examiner*—Stanley N. Gilreath
*Attorney, Agent, or Firm*—Walter G. Finch

[57] ABSTRACT

A creel adapter is provided for the securing of yarn spooled on parallel and tapered type yarn package tubes which are to be placed into position for further processing in the carpet industry. The entire device rests on a base plate which contains a hole suitable for a passing shaft, thus connecting the device to existing machinery. The adapter consists of a rear hub with six heavy ribs which secure parallel type tube yarn packages. The rounded ends of the ribs allow badly damaged parallel type tube ends to pass over and slide to the rear flange of the base plate. Tapered type tube yarn packages are positioned so that the larger end of the tube rests centered on the base of a conical portion of the creel adapter hub, while a circumference on the inner diameter of the upper portion of the cone rests tangent with the outer diameter of the top of a protruding tube on the adapter device. Three whiskers stemming from the protruding tube cut into the inner diameter of the tapered type tube as it is pushed into position, thus preventing forward creep of the yarn package (no rotation). The three whiskers are of sufficient length and resilience to put pressure on the inner diameter of the parallel type tubes as they are placed in position.

1 Claim, 2 Drawing Sheets

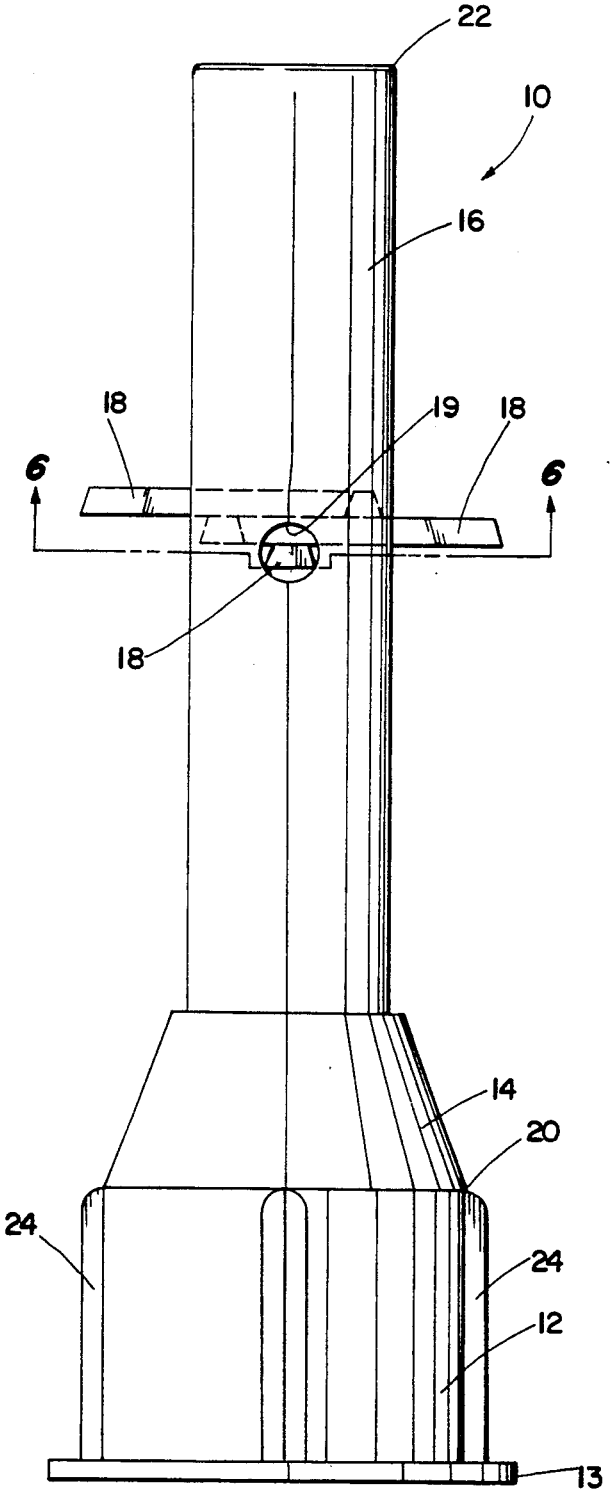
Fig. 4
Fig. 5
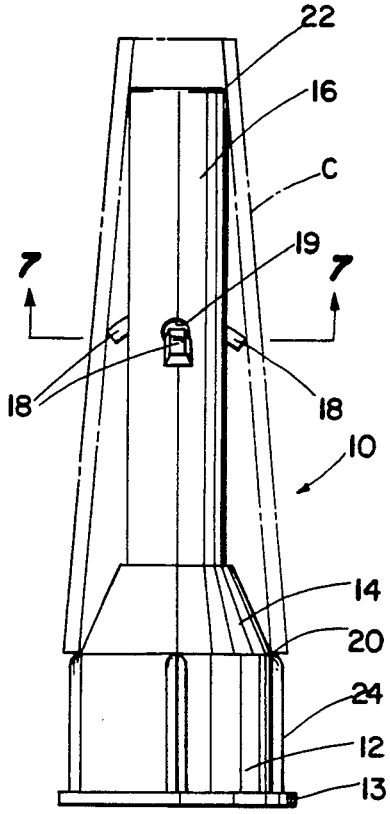
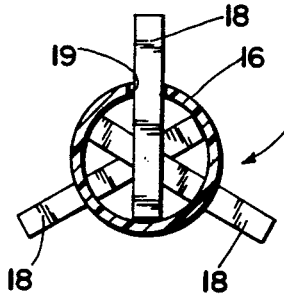
Fig. 6
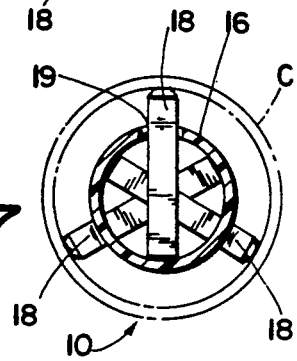
Fig. 7

CREEL ADAPTER

BACKGROUND OF INVENTION

This invention relates to the weaving industry and more particularly deals with an adapter used to house yarn packages during the weaving process in the carpet industry.

BEST KNOWN PRIOR ART

The best known prior U.S. art is as follows:

| | | |
|---|---|---|
| 2,300,223 | 2,784,917 | 4,106,712 |
| 2,583,482 | 2,838,922 | 4,687,151 |
| 2,584,320 | 3,339,862 | 4,921,186 |
| 2,733,868 | 4,056,243 | |

U.S. Pat. No. 2,300,223 issued to Ruf teaches the use of apparatus having a suitable speed regulator control which regulates the speed of a winding operation, while the U.S. patent to Greenberg, U.S. Pat. No. 2,583,482 teaches the use of a protector for the bobbin holder of a sewing machine.

The Hamlett U.S. Pat. No. 2,733,868 teaches a controlled bobbin winder for a sewing machine. The Bono U.S. Pat. No. 2,784,917 relates to and illustrates a thread filler device for filling the bobbin of the shuttle of a sewing machine. The gift U.S. Pat. No. 2,838,922 teaches a yarn control device that prevents the yarn from becoming twisted, snarled and the like while in the machine.

The Parker U.S. Pat. No. 3,339,862 teaches a process for unwinding yarn from a wound package, while the U.S. Pat. No. 4,106,712 to Savio, et al provide a mechanism for controlling the tension of yarn which is unwound from a yarn supporting body.

The second Savio, et al U.S. Pat. No. 4,153,214 is similar to the Savio et al U.S. Pat. No. 4,106,712 previously described.

U.S. Pat. No. 4,056,243 issued to Bilodeau is for apparatus which uniformly unwinds a yarn package. U.S. Pat. No. 4,687,151 issued to Memmingeral is directed to a textile yarn pull-off system. The Plasby U.S. Pat. No. 4,921,186 teaches mechanism for withdrawing yarn from a yarn wound package.

OBJECTS OF THE INVENTION

It is an object of this invention to provide an adapter for securing yarn packages for weaving in the manufacturing process.

Another object of this invention is to provide novel adapter mechanism for securing and controlling yarn packages for weaving in the carpet and/or similar industries.

Still other objects of this invention are to provide an apparatus readily adaptable to existing machines, simplistic in design, inexpensive to manufacture, and easy to operate and maintain.

To provide an apparatus capable of securing yarn wound on both parallel tube and tapered cone packages, is another object of this invention.

To provide a device which prevents the forward creep of the yarn package in the event of pulling or tugging on either the parallel or tapered cone tube packages, is still another object of this invention.

And to provide an apparatus which gives sufficient front end support to either the parallel or tapered cone packages, is a further object of this invention.

BRIEF DESCRIPTION OF THE DRAWINGS

These and other objects and attendant advantages of this invention will become more obvious and apparent from the following detailed specification and accompanying drawings in which:

FIG. 4 is a side view of the creel adapter;

FIG. 5 is a side view of the creel adapter of FIG. 1 engaged with a tapered cone tube;

FIG. 6 is a top view of the three elastic whiskers of the creel adapter of FIG. 1; and FIG. 7 is a top view of the three elastic whiskers of the creel adapter of FIG. 1 with their ends engaged in the inner diameter of a tapered cone tube.

DESCRIPTION OF THE PREFERRED EMBODIMENTS OF THE INVENTION

Figure 1:
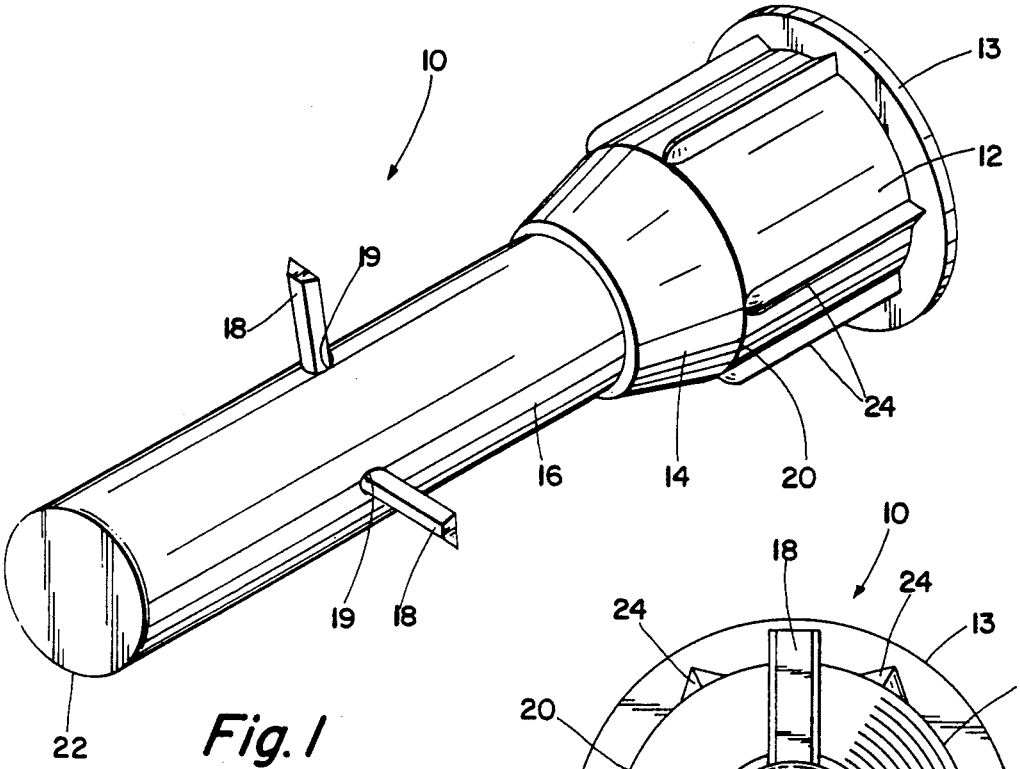
FIG. 1 is a perspective view of a creel adapter incorporating novel features of this invention.
Figure 2:
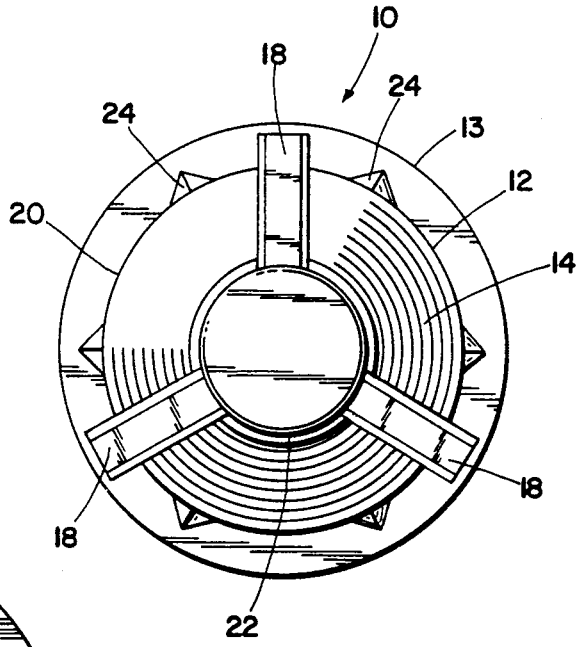
FIG. 2 is a top view of the device of FIG. 1.
Figure 3:
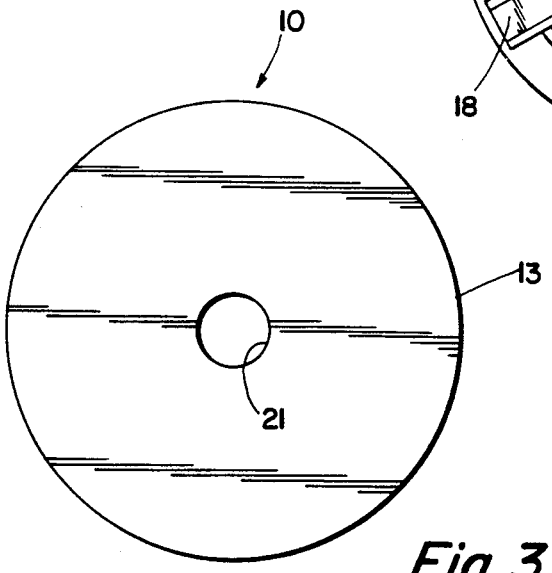
FIG. 3 is a top view of the base plate of the creel adapter of FIG. 1.

Referring now to FIGS. 1 to 7 of the drawings, there is shown the preferred embodiment of a creel adapter 10, simplistic in design and readily usable.

This creel adapter 10 is supported by a base plate 13 with an opening 21 through which a shaft may pass to connect creel adapter 10 to existing machinery. The creel adapter 10 comprises a rear hub 12, a conical portion 14, and a protruding tube 16 topped off with a cap 22.

The rear hub 12 is provided with six spaced heavy ribs 24 with rounded heads at their outer ends (generally used in near horizontal plane) and sharp edges along their lengths. The rounded ends of the six spaced ribs 24 allow a cylindrical tube, not shown, but considered for purposes of understanding to be with badly damaged ends to pass over and slide back to the rear flange of the base plate 13. The sharp edges along the lengths of the six ribs 24 cut into the inner periphery of a right cylinder type tube and hold it stationary, parallel to the fixed thread guide out beyond the yarn package, preventing forward creep of said yarn package.

The tapered type tube (or cone) C, best seen in FIG. 5, has its larger end rest centered on the rear-most circumference or periphery 20 of the conical portion 14 of the creel adapter 10. The top portion of the protruding tube 16 is at such a length that its outer diameter of cap 22 matches the inner diameter for the inner periphery of the cone C at a predetermined point inside the cone C as determined by the degree of taper of a cone desired to be disposed thereover. Thus, support at the outer end of the cone C is achieved, all as shown in FIG. 5.

The protruding tube 16 has three holes or apertures 19 cut into its face through which three elastic and flexible whiskers 18 are fixed in a manner well known to practitioners in the art, such for example as cementing, or thermal fusion adhesion at the centerline of the tube or by their inner ends or both, accomplished at the time of assembly during manufacture of the adapter. These three whiskers 18 bend toward the rear hub 12 when the cone C is pushed into position. The sharp edges on the outer ends of the three whiskers 18 tend to cut into the inner periphery of the cone C or cylindrical type package and subsequently prevent forward yarn package creep (packages are stationary). The whiskers 18 are of sufficient, length and elasticity to bend back and place pressure on the inner peripheral surface of the properly positioned cone or cylindrical type package.

In light of the above teachings, it is clear that modifications may be made to the invention without changing its scope or purpose. It is, therefore, to be understood that within the scope of the appended claims, the invention may be practiced otherwise than specifically described.

What is claimed is:

1. A creel adapter of a character for use to fix yarn spooled on either cylindrical or tapered type tubes, comprising, a base plate large enough to create a flange, a rear hub connected to said base plate and extending longitudinally therefrom, a conical portion connected next to the front end of said rear hub, a protruding terminal end tube disposed adjacent to said conical portion and extending longitudinally co-axially with said base plate, rear hub, and conical portion and means for fixedly engaging and retaining either a cylindrical tube or a tapered tube thereon wherein said last mentioned means includes a plurality of portions along said rear hub which are equipped with a plurality of longitudinally disposed radially extending ribs, all of which ribs have rounded heads remotely disposed relative to said base plate for the passage thereover of a cylindrical type tube end, all of said ribs having sharp edges peripherally disposed along their lengths for providing for firmly fixing of a cylindrical type tube thereon, said last mentioned means further including a plurality of outwardly extending sharp ended whiskers which tend to cut into the inner peripheral surface of either a tapered type tube or a cylindrical type tube as may selectively be positioned thereon to prevent either type tube from creeping forward.

* * * * *